US006530413B2

(12) United States Patent
Hwang

(10) Patent No.: US 6,530,413 B2
(45) Date of Patent: Mar. 11, 2003

(54) FOLDABLE BLIND ASSEMBLY

(76) Inventor: Shiyang Hwang, No. 375, Gin Din Rd., San Min District, Kaohsiung City (TW)

( * ) Notice: Subject to any disclaimer, the term of this patent is extended or adjusted under 35 U.S.C. 154(b) by 0 days.

(21) Appl. No.: 09/884,024

(22) Filed: Jun. 20, 2001

(65) Prior Publication Data

US 2002/0195209 A1 Dec. 26, 2002

(51) Int. Cl.[7] ..... E06B 3/94
(52) U.S. Cl. ..... 160/84.03
(58) Field of Search ..... 160/84.03, 84.01, 160/84.04, 167 R, 38, 19

(56) References Cited

U.S. PATENT DOCUMENTS 3,093,186 A * 6/1963 Castanedo ..... 160/170 R
3,192,991 A * 7/1965 Anderle ..... 160/170 R
3,528,477 A * 9/1970 Abraham ..... 160/84.03
3,552,473 A * 1/1971 Persson ..... 160/166 R
3,593,772 A * 7/1971 Abraham ..... 160/84.01
3,996,987 A * 12/1976 Rodriguez ..... 160/38 X
4,813,468 A * 3/1989 Fraser ..... 160/84.01
4,953,610 A * 9/1990 Philips et al. ..... 160/84.01
4,955,419 A * 9/1990 Morris ..... 160/38
5,598,880 A * 2/1997 Cross ..... 160/38

* cited by examiner

*Primary Examiner*—David M. Purol
(74) *Attorney, Agent, or Firm*—Troxell Law Office PLLC

(57) ABSTRACT

A foldable blind assembly is equipped with a shelter slat which can be changeably attached to a fixed beam of the blind so as to cover the commonly exposed fixed beam to make the blind assembly appealing to eyes. In addition, a moving beam mounted under the fixed beam permits the blind to selectively cover the upper, middle or lower portion of a window or a door, making the use of the blind assembly in a variable manner.

2 Claims, 7 Drawing Sheets

FOLDABLE BLIND ASSEMBLY

BACKGROUND OF THE INVENTION

The present invention relates to a foldable blind assembly which is equipped with a shelter slat which can be changeably attached to a fixed beam of the blind so as to cover the commonly exposed fixed beam to make the blind assembly appealing to the eyes. In addition, a moving beam movably mounted under the fixed beam permits the blind to selectively cover the upper, middle or lower portion of a window or a door, making the blind assembly usable in a variable manner.

Referring to FIG. 1, a conventional blind is equipped with an upper beam 11, a cloth curtain 12, a plurality of ring elements 13, a retaining device 14, and a pull cord set 15. The upper beam 11 is secured to the top of a door or window and the cloth curtain 12 foldable into layers or a pile in a consecutive order is attached to the underside of the upper beam 11. A ring element 13 is fixed to each end of a slat layer of the cloth curtain 12. The pull cord set 15 is guided into the retaining device 14 and is wound around the upper portion and is led downwardly via a hole at each end of the upper beam 11 and further through the ring elements 13. The bottom end of the cord set 15 is tied into a knot at the lowermost ring elements 13 respectively.

In use, as shown in FIG. 1, as the pull cord set 15 is pulled downwardly, the ring elements 13 of the bottommost slat layer 12 are forced to move upwardly along with the slat layers 12 piled up layer by layer consecutively. As long as the pulling action is stopped, the cloth curtain 12 will be retained at a proper height by the retaining device 14 to provide a shade area between the upper beam 11 and the collected cloth curtain 12.

As to the structure of the prior art blind assembly, there are a number of disadvantages:

1. The upper beam 11 is exposed externally and is not matching in color and style with the cloth curtain 12.
2. The cloth curtain 12 is only limited to cover a door and a window between the upper beam 11 and the cloth curtain 12. The lower portion and the upper portion thereof can not be separately covered.

SUMMARY OF THE INVENTION

Therefore, the primary object of the present invention is to provide a foldable blind assembly secured to a door or window. A shelter slat having a buckling belt secured to the upper edge thereof is changeably attached to a fixed beam which has a corresponding buckling belt disposed on the inner side of the fixed beam so as to permit the shelter slat to be removably mounted and dismantled with ease for a change. Thereby the fixed beam can be hidden behind the shelter slat and make the shelter slat to be appealing to eyes and artistically match with the movable blind assembly.

Another object of the present invention is to provide a foldable blind assembly which is provided with a moving beam and a movable blind assembly that can be easily positioned at any position, such as at the upper, lower or middle of a window or door as desired.

One further object of the present invention is to provide a foldable blind assembly wherein the shelter slat can be easily and quickly mounted to and dismantled from the fixed beam for cleaning or replacement for a change to make the blind assembly appealing to eyes.

DETAILED DESCRIPTION OF THE PREFERRED EMBODIMENTS

Figure 1:
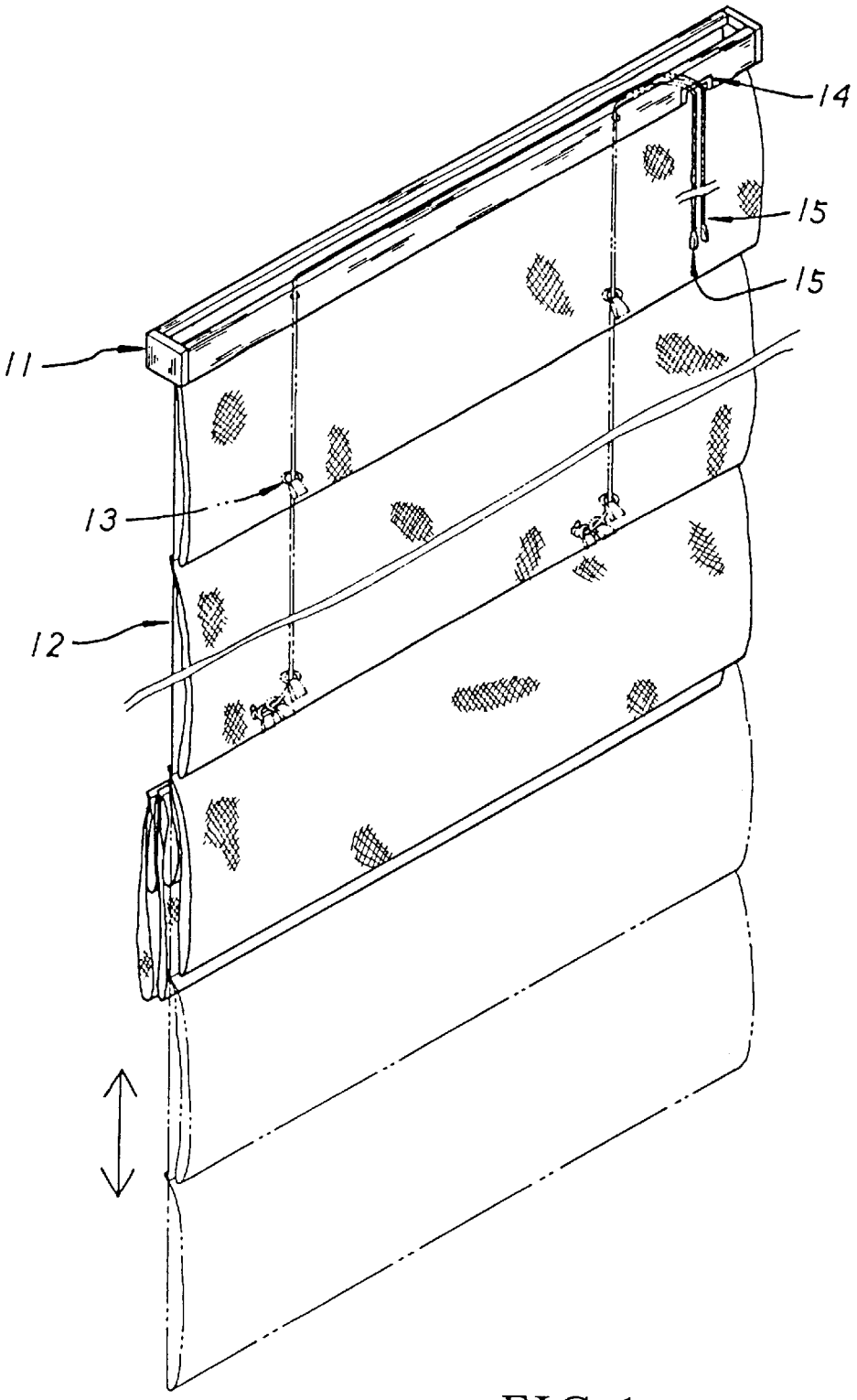
FIG. 1 PRIOR ART
FIG. 1 is a perspective diagram showing the appearance and operation of a prior art.
Figure 2:
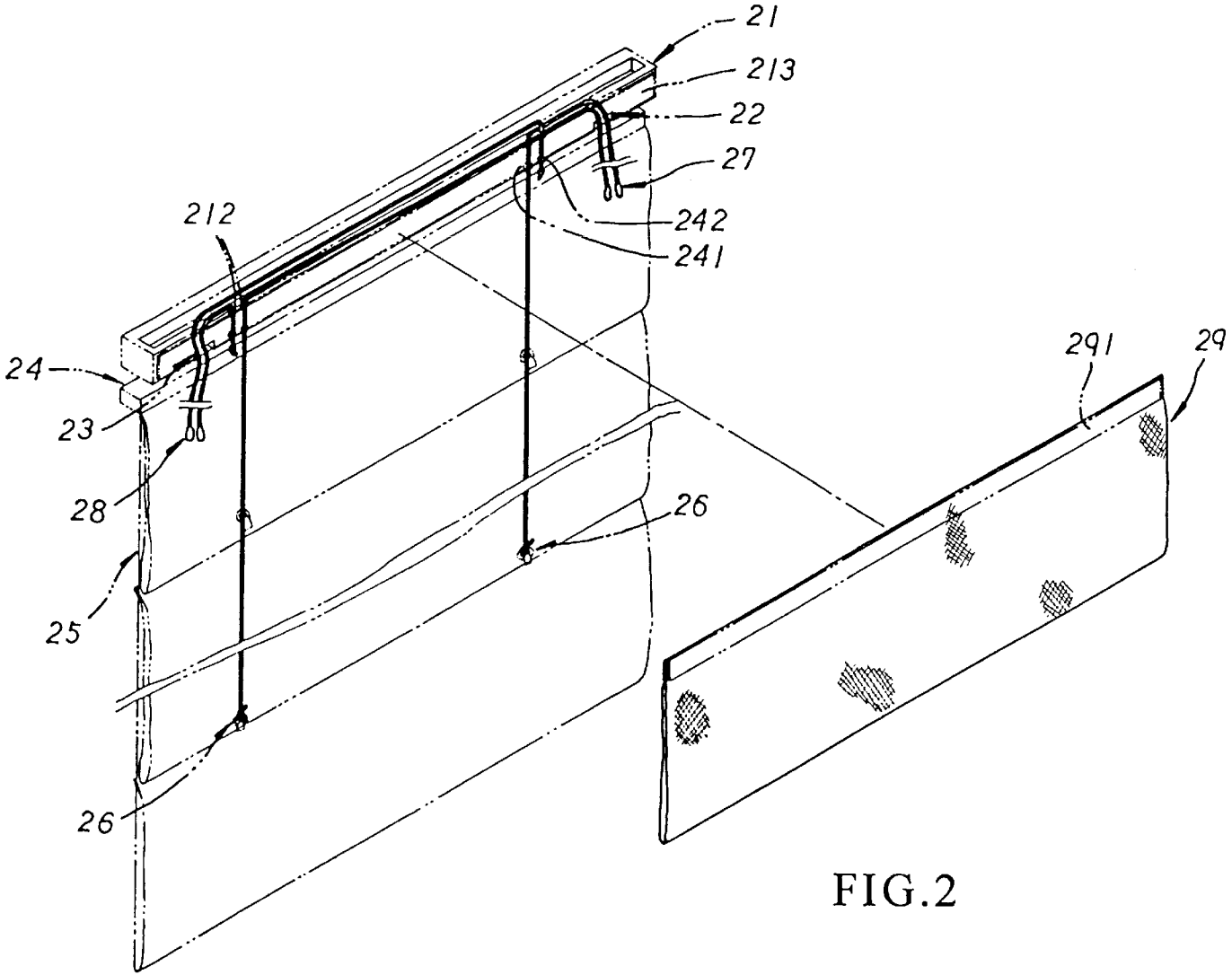
FIG. 2 is a perspective diagram showing the exploded components of the present invention.

Referring to FIG. 2, the exploded components of the present invention are illustrated. It mainly includes a fixed beam 21, a lower retaining device 22, an upper retaining device 23, a moving beam 24, a movable blind assembly 25, a plurality of ring elements 26, a down-pull cord 27, an up-pull cord 28 and a shelter slat 29.

On an inner side of the fixed beam 21 are disposed a lower retaining device 22 at the right end and an upper retaining device 23 at the left end. At the bottom of the fixed beam 21 are disposed a pair of through holes 212 at each end. A female buckling belt 213 (or male buckling belt) is also secured to the inner side without spoiling the normal operation of the lower retaining device 22 and the upper retaining device 23.

The moving beam 24 placed under the fixed beam 21 has a first through hole 241 and a second through hole 242 symmetrically disposed on the top surface at each end. The movable blind assembly 25 fixed under the moving beam 24 is of proper length and are folded layer by layer into a pile from up to down. Each folded layer is provided with a number of ring elements 26 that are positioned right under the first through hole 241 of the moving beam 24. The down-pull cord 27 is made up of two or more pieces that are led into the lower retaining device 22 disposed at one end of the fixed beam 21 and further into the interior of the fixed beam 21. The two pieces are respectively led out of one of the paired through holes 212 at each end of the fixed beam 21 and further led via the first through hole 241 of the moving beam 24 and finally pass sequentially the ring elements 26 located at each end of the movable blind assembly 25. The end of each cord is tied into a knot at the bottommost ring element 26.

The up-pull cord 28 made up of two or more pieces is led through the upper retaining device 23 at the opposite end of the fixing beam 21 and into the interior of the fixing beam 21. The two cord pieces 28 are further led via the other remaining through hole 212 at each end of the fixed beam 21 and via the second through hole 242 of the moving beam 24 and is secured in place at the respective position.

The shelter slat 29 is approximately equal in length of the fixing beam 21 and also has an identical length of each layer of the movable blind assembly 25. On the inner side of the shelter slat 29 is disposed a male or female buckling belt 291 in locking engagement with the female buckling belt 213 secured to the inner side of the fixed beam 21.

Figure 3:
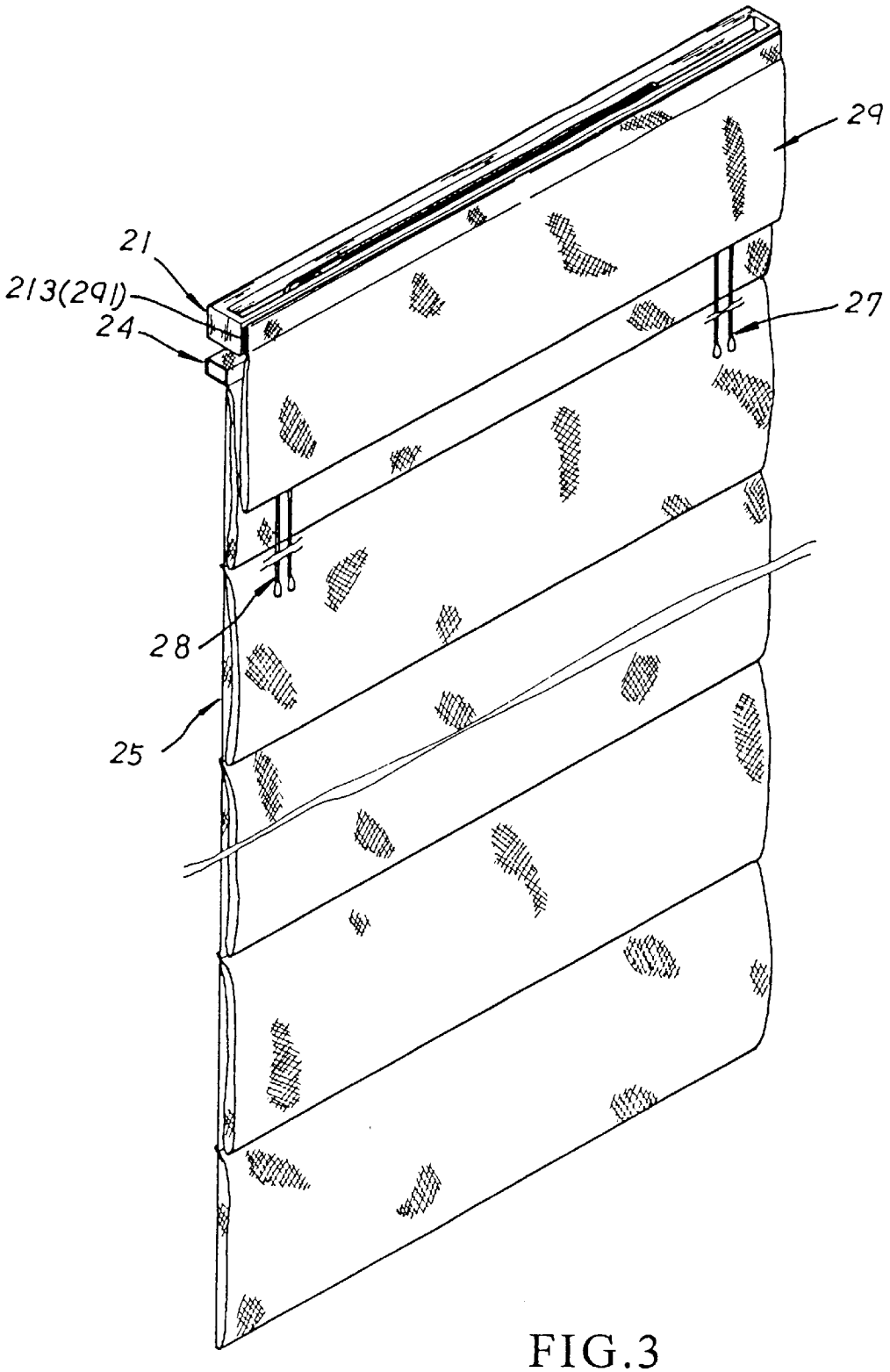
FIG. 3 is a perspective diagram showing the assembly of the present invention.

Referring to FIG. 3, the fixed beam 21 is secured to the upper edge of a door or window and the shelter slat 29 is secured to the inner side of the fixed beam 21 by the engagement of the male and female buckling belts 213, 291.

Figure 4:
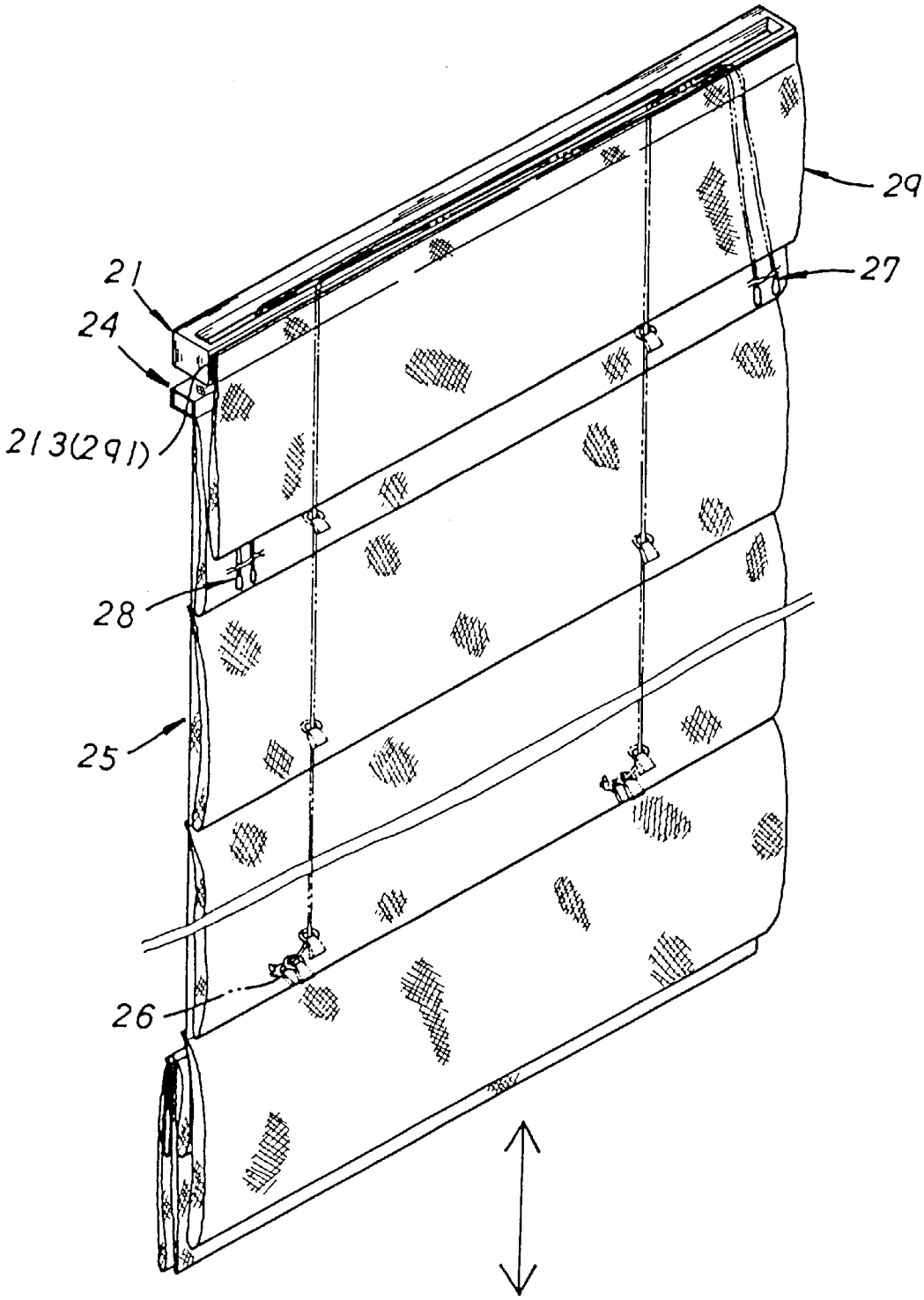
FIG. 4 is a diagram showing one of the operation modes thereof.
Figure 5:
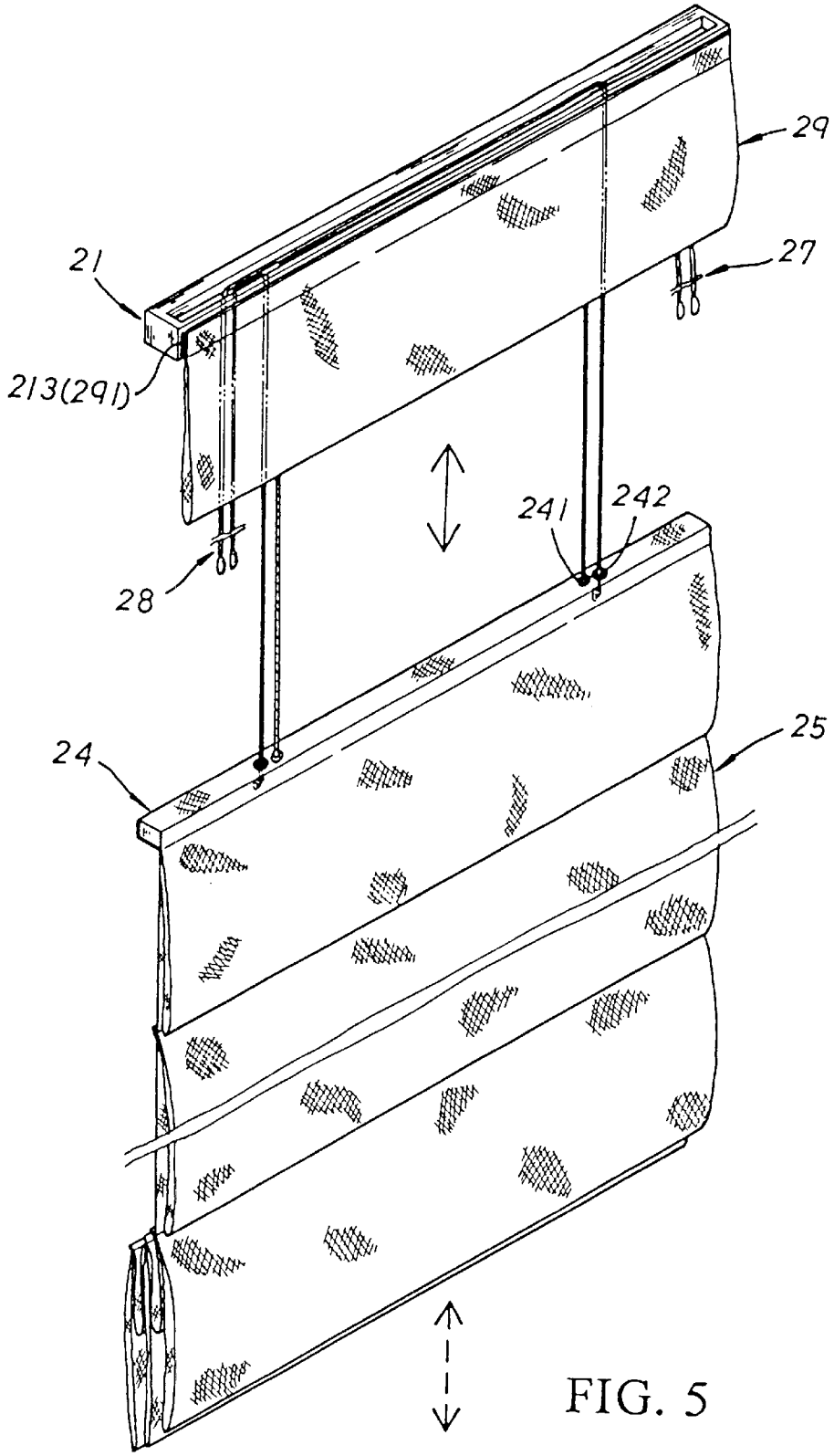
FIG. 5 is a diagram showing another varied operation mode thereof.

Referring to FIGS. 4, 5, in operation, as the down-pull cord 27 is pulled downwardly, the ring elements 26 engaged with the end of the down-pull cord 27 and the layer of the movable blind assembly 25 associated with the ring elements 26 are simultaneously pulled up, resulting in the piling of the layers of the movable blind assembly 25 at a proper height. If the up-pull cord 28 is pulled upwardly, the moving beam 24 can be lifted to a proper position whereby the movable blind assembly 25 can be placed at the upper, middle or lower portion of a window or a door as desired.

Figure 6:
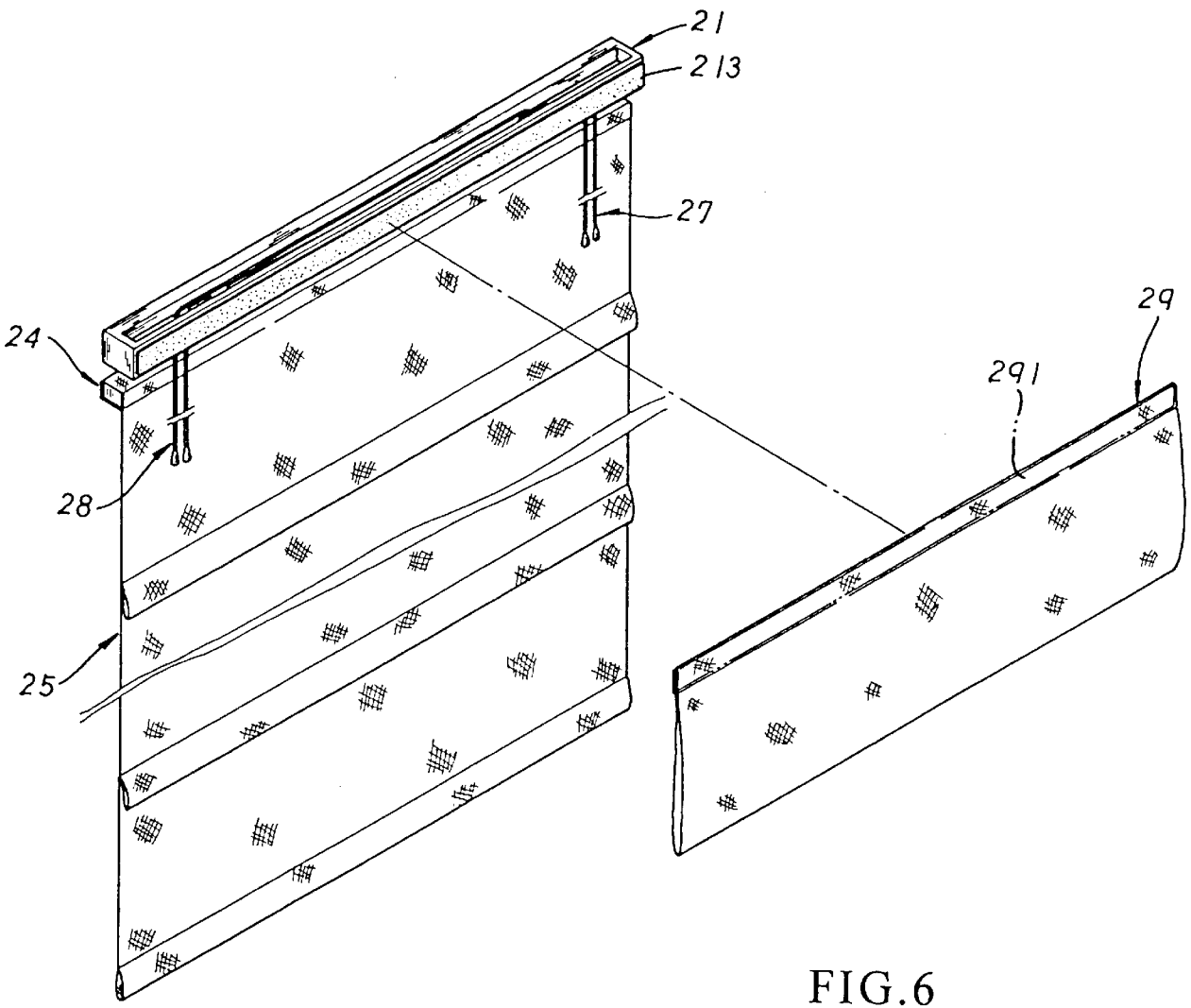
FIG. 6 is a perspective diagram showing the exploded components of another embodiment.
Figure 7:
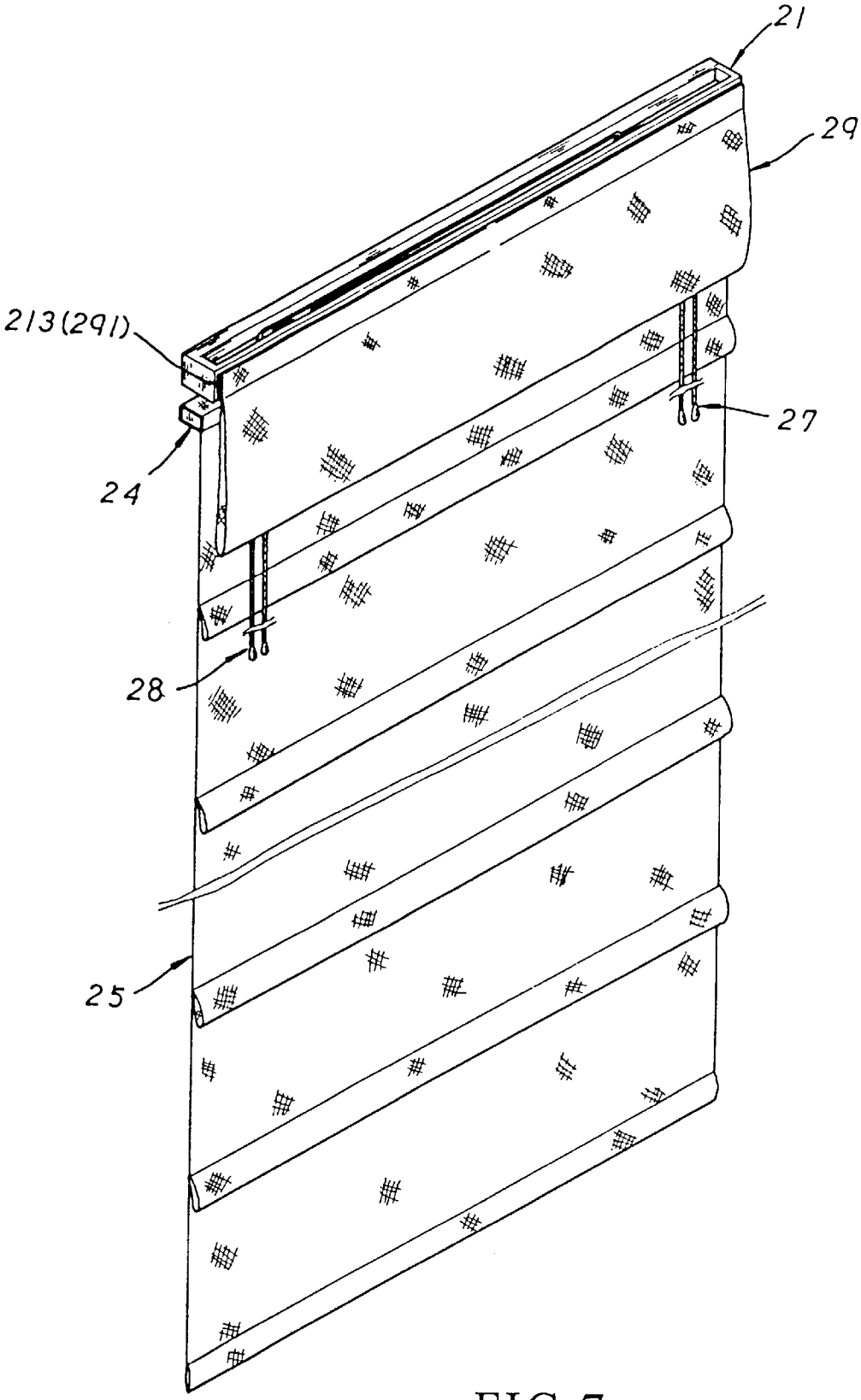
FIG. 7 is a perspective diagram showing the assembly of another embodiment.

Referring to FIGS. 6, 7, the exploded and assembled blind assembly of another embodiment of the present invention are shown wherein various type of the movable blind assembly 25 is illustrated. It operates in the same manner and enjoys the same functions.

In summary, the present invention has the following advantages in practical use.

1. The shelter slat 29 is changeably secured to the fixed beam 21 by the male and female buckling belts 213, 291 so that the fixed beam 21 can be covered to make the same appealing to eyes; and the shelter slat 29 of different color and style can be used for a change.
2. The movable blind assembly 25 can be randomly positioned at any place on a door or window without limit so as to make the cover of the window and door in a variable manner.
3. The shelter slat 29 is easily and quickly attached to the fixed beam 21 so that the shelter slat 29 can be dismantled for cleaning or replacement for a change.

I claim:

1. A foldable blind assembly comprising:

a) a fixed beam including first and second retaining devices, a bottom with a plurality of first through holes and a side face;

b) a movable beam located below the bottom of the fixed beam, the movable beam including a plurality of second through holes;

c) an up-pull cord assembly having a first end located exteriorly of the fixed beam, the up-pull cord assembly passing through the second retaining device into an interior of the fixed beam, passing through the plurality of first holes and a second end mounted to the movable beam, whereby movement of the first end causes movement of the movable beam relative to the fixed beam;

d) a movable cloth blind assembly attached to the movable beam and including a plurality of transverse folded layers along a length thereof, each folded layer having ring elements;

e) a down-pull cord assembly having a first end located exteriorly of the fixed beam, the down-pull cord assembly passing through the first retaining device in the interior of the fixed beam, through the plurality of first through holes, through the plurality of second through holes and through the ring elements, and a second end configured so as to engage lowermost ring elements, whereby movement of the first end causes movement of a lowermost edge of the cloth blind relative to the movable beam; and, f) a shelter slat removably attached to the side face of the fixed beam and extending along an entire width of the fixed beam, the shelter slat extending below the movable beam when the movable beam is adjacent to the fixed beam.

2. The foldable blind assembly of claim 1 wherein the plurality of folded layers have a common length, and the shelter slat has a length equal to the common length.

* * * * *